United States Patent [19]

Fujii et al.

[11] Patent Number: 4,703,295

[45] Date of Patent: Oct. 27, 1987

[54] ELECTROMAGNETIC RELAY HAVING PRECISE POSITIONAL RELATIONSHIP BETWEEN ELEMENTS

[75] Inventors: Kunihisa Fujii, Saku; Noboru Tomono, Minamisaku; Tetsuo Kito, Saku; Kosei Yoshino, Komoro, all of Japan

[73] Assignee: Takamisawa Electric Co., Ltd., Tokyo, Japan

[21] Appl. No.: 774,186

[22] Filed: Sep. 9, 1985

Related U.S. Application Data

[63] Continuation of Ser. No. 396,272, Jul. 8, 1982.

[30] Foreign Application Priority Data

Jul. 20, 1981 [JP] Japan ..... 57-112121

[51] Int. Cl.[4] ..... H01H 67/02

[52] U.S. Cl. ..... 335/129

[58] Field of Search ..... 335/128, 129

[56] References Cited

U.S. PATENT DOCUMENTS

| | | | |
|---|---|---|---|
| 3,688,229 | 8/1972 | Bloch | 335/203 |
| 3,711,801 | 1/1973 | Bloch | 335/187 |
| 4,031,493 | 6/1977 | Van Der Wirlen | 335/128 |
| 4,193,052 | 3/1980 | Hayden | 335/128 |
| 4,359,703 | 11/1982 | Schedele | 335/128 |
| 4,364,018 | 12/1982 | Dammert et al. | 335/106 |
| 4,377,798 | 3/1983 | Schedele | 335/128 |

FOREIGN PATENT DOCUMENTS

| | | | |
|---|---|---|---|
| 2214324 | 10/1973 | Fed. Rep. of Germany | 335/129 |
| 2617632 | 11/1977 | Fed. Rep. of Germany | 335/128 |
| 452704 | 5/1968 | Switzerland | 335/128 |

*Primary Examiner*—Patrick R. Salce
*Assistant Examiner*—Jeffrey Sterrett
*Attorney, Agent, or Firm*—Armstrong, Nikaido, Marmelstein & Kubovcik

[57] ABSTRACT

An electromagnetic relay constructed by assembling an electromagnet portion including an armature of a straight bar shape arranged adjacent to a magnetic pole piece; a fixed contact spring; and a spring holding portion including a movable contact spring driven by a card driven by the armature, so that the precise portional relationship between elements of the electromagnetic relay is realized.

3 Claims, 7 Drawing Figures

ELECTROMAGNETIC RELAY HAVING PRECISE POSITIONAL RELATIONSHIP BETWEEN ELEMENTS

This is a continuation of application Ser. No. 396,272 filed July 8, 1982.

BACKGROUND OF THE INVENTION

Field of the Invention

The present invention relates to an electromagnetic relay, more specifically to an electromagnetic relay of the size of, for example, 20 mm ×10 mm ×15 mm.

Description of the Prior Art

An example of a prior art electromagnetic relay is described with reference to FIG. 1, which is one of the drawings indicated in the "brief description of the drawings" set forth later. The electromagnetic relay of FIG. 1 comprises bobbin 110, coil 120, pole piece 152, yoke 153, armature 140 of a bent bar shape, hinge spring 141, card 160, movable contact springs 31*m* (make-contact side) and 31*b* (break-contact side), fixed contact spring 210, restoring spring 4, insulators 51, 52, 53, 54, and 55, stop metal 7, connection screw 6, and pressure screw 8. The electromagnet structure (110, 120, 152, 153, 140), hinge spring 141, and the spring structure (31*m*, 31*b*, 210, 4, 51, 52, 53, 54, 55, 7, 8) are combined as an electromagnetic relay assembly by using connection screw 6. Card 160 is arranged between armature 140 and movable contact springs 31*m*, 31*b*.

In the electromagnetic relay of FIG. 1, there are problems in realizing the precise positional relationships between the various elements of the electromagnetic relay and ensuring the sensitive and uniform operation of the electromagnetic relay by relatively low electric power. This is mainly because the error in the positions of the elements of the electromagnetic relay cannot be reduced to below a predetermined level due to the accumulation of positional errors of the plurality of the movable and fixed contact springs and the hinge spring. Hence, it is difficult to keep the distance between the driving edge of the card and the surface of the movable contact within a predetermined allowable value.

Also, in the electromagnetic relay of FIG. 1, the variation of the distance between one end 140*a* of armature 140 and pole piece 152 causes greater variation of the stroke of the other end 140*b* of armature 140 due to the so-called "lever ratio" of armature 140. Also, it is not easy to manufacture such a bent bar shape armature with high precision. Thus, it is generally difficult to ensure the sensitive and uniform operation of the electromagnetic relay by relatively low electric power.

SUMMARY OF THE PRESENT INVENTION

It is the main object of the present invention to provide an improved electromagnetic relay in which the precise positional relationship between elements of the electromagnetic relay is realized and sensitive and uniform operation of the electromagnetic relay by relatively low electric power is ensured.

In accordance with the fundamental aspect of the present invention, there is provided an electromagnetic relay comprising:

an electromagnet portion including a bobbin, a coil wound on said bobbin, a magnetic pole piece, and a magnetic yoke inserted in said bobbin, an armature of a straight bar shape arranged adjacent to said magnetic pole piece, and a card coupled to said armature;

a spring holding portion including a base block, a first fixed contact spring, and a movable contact spring, the first fixed contact spring and said movable contact spring being embedded in the base block, the movable contact spring being adapted to be driven by the card; and a second fixed contact spring located between the bobbin and the movable contact spring.

DESCRIPTION OF THE PREFERRED EMBODIMENT

Figure 1:
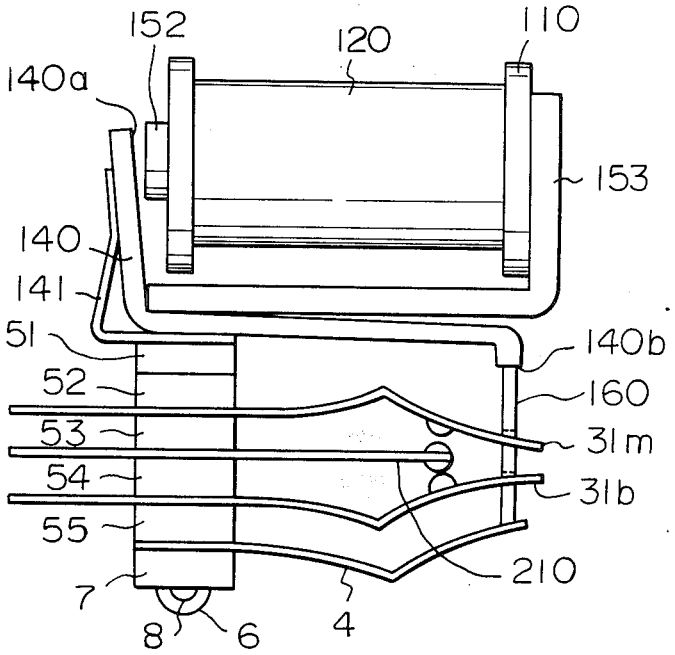
Fig. 1 PRIOR ART
FIG. 1 illustrates an example of a prior art electromagnetic relay.
Figure 2:
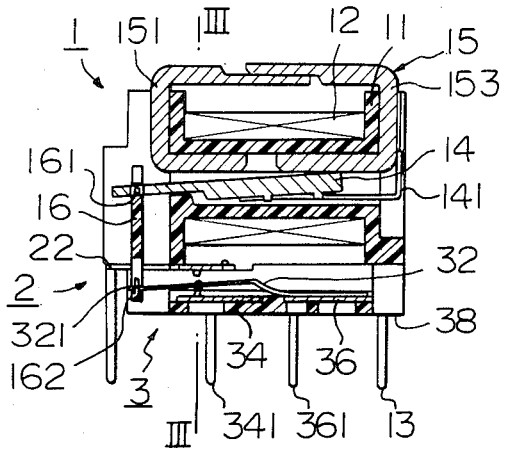
FIG. 2 illustrates an electromagnetic relay according to an embodiment of the present invention.
Figure 3:
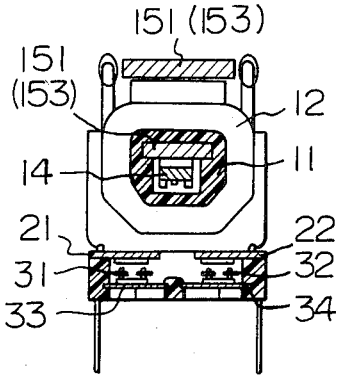
FIG. 3 illustrates the cross-sectional view taken along line III—III of FIG. 2.

An electromagnetic relay according to an embodiment of the present invention is illustrated in FIG. 2. FIG. 3 illustrates a cross-sectional view of the electromagnetic relay of FIG. 2.

The electromagnetic relay of FIGS. 2 and 3 consists of three constituent portions, that is, electromagnet structure 1, make-side fixed-contact spring portion 2, and spring holding structure 3.

Electromagnet structure 1 comprises bobbin 11 made of plastic, coil 12 having coil terminal 13, armature 14, a hinge spring 141, magnetic body 15 having pole piece 151 and yoke 153, and card 16, one edge portion 161 of which is coupled to armature 14.

Make-side fixed contact spring portion 2 consists of a pair of make-side fixed contact springs 21 and 22.

Spring holding structure 3 comprises base block 38 made of plastic, movable contact springs 31 and 32, and break-side fixed-contact springs 33 and 34. The springs 35 and 36 are provided beneath the movable contact springs 31 and 32, respectively. Movable contact spring 31 is fixed to spring 35, while movable contact spring 32 is fixed to spring 36. Spring 36 has terminal 361. Break-side fixed contact spring 34 has terminal 341. The movable contact springs 31 and 32 are driven at their ends 311 and 321 by edge portion 162 of card 16. Break-side fixed-contact springs 33, 34 are regarded as the first fixed-contact spring, while make-side fixed-contact springs 21, 22 are regarded as a second fixed-contact spring.

Figure 4:
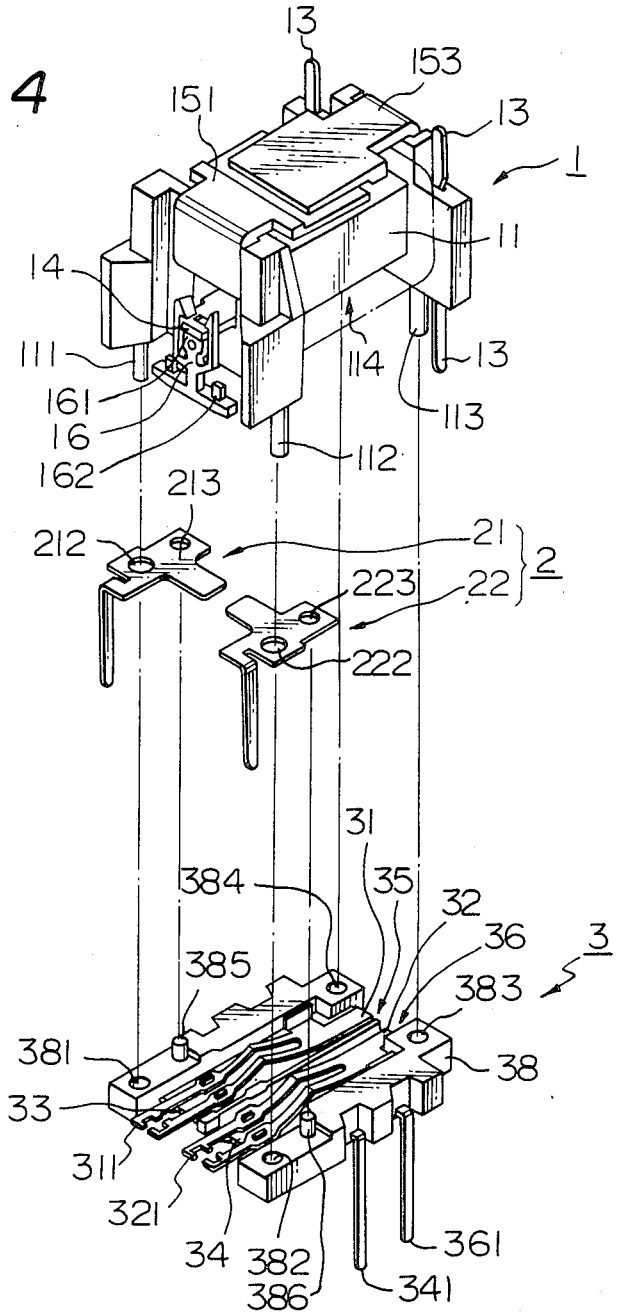
FIG. 4 illustrates the process of assembly in the manufacture of the electromagnetic relay of FIG. 2.

The manner of assembly of these three constituent portions 1, 2, and 3 will be described with reference to FIG. 4. Bobbin 11 has projections 111, 112, 113, and 114. Make-side fixed-contact springs 21 and 22 have holes 212, 213, 222, and 223. Base block 38 has holes 381, 382, 383, and 384 and projections 385 and 386.

These three constituent portions 1, 2, and 3 are combined by inserting projections 111 and 112 through holes 212 and 222 into holes 381 and 382, inserting projections 113 and 114 into holes 383 and 384, and inserting projections 385 and 386 into holes 213 and 223. Card 16 connects the end of armature 14 and ends 311, 321 of movable contact springs 31, 32. Card 16 receives the driving force of armature 14 at edge portion 161 and transmits the driving force to movable contact springs 31, 32 at edge portions 162.

In the device of FIGS. 2 and 3, the sizes of the elements of the device and the distances between the important portions of the device can be established to a high precision by increasing the precision of the plastic molding process used in the manufacturing process of the device.

Figure 5:
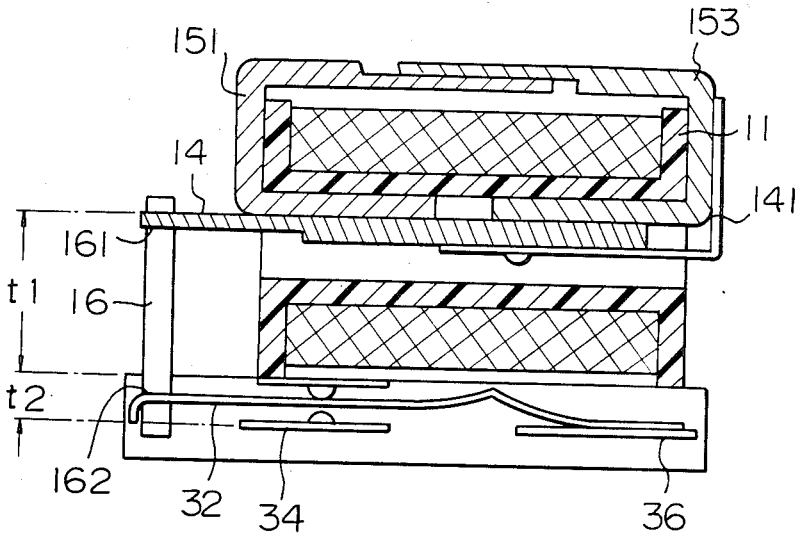
FIG. 5 illustrates the operation of the electromagnetic relay of FIG. 2.

For example, as shown in FIG. 5, distance t1 between the contact surface of armature 14 to pole piece 151 and the edge surface of bobbin 11 and distance t2 between the edge surface of bobbin 11 and the surface of break-side fixed-contact spring 34 are precisely established. Hence, the relative arrangement of driving edge portions 162 of card 16 and the surface of movable contact springs 32 is precisely established. This minimizes the variation in the distance between driving edge portions 162 of card 16 and the surface of movable contact springs 32 and, accordingly, minimized the variation in the travel-force characteristic of the contact spring.

Also, in the device of FIGS. 2 and 3, the shaping of the armature as a simple straight bar means there is no variation in the stroke of the movable edge, which would normally occur in an armature of a conventional bent bar shape. Further, the variation in the distance between armature 14 and pole piece 151 can be minimized by enhancing the precision of the central hole of the bobbin into which pole piece 151 and yoke 153 and armature 14 are inserted.

Figure 6:
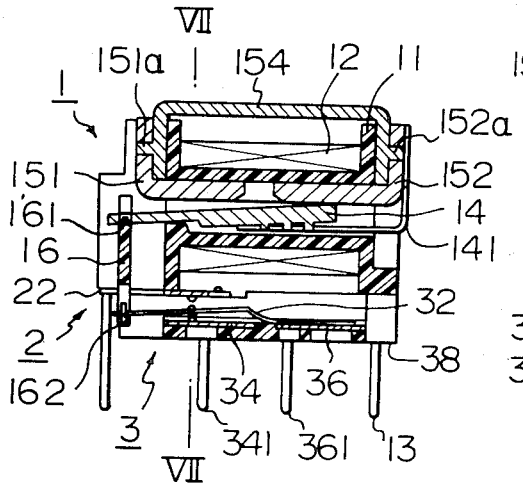
FIG. 6 illustrates another embodiment of the present invention.
Figure 7:
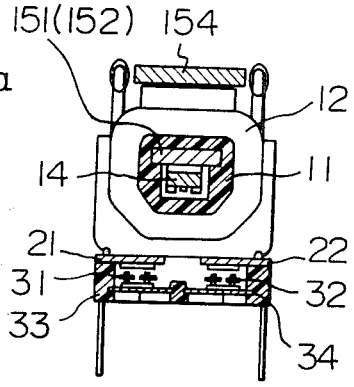
FIG. 7 illustrates a cross-sectional view taken along line VII—VII of FIG. 6.

A modified embodiment of the present invention is illustrated in FIG. 6. FIG. 7 illustrates a cross-sectional view of the device of FIG. 6. The device of FIG. 6 is structured similarly to that of the device of FIGS. 2 and 3. However, in the device of FIG. 6, magnetic body consists of pole piece 151, yoke 152, and connecting yoke member 154. The projections provided in connecting yoke member 154 are inserted into holes 151*a* and 152*a* provided in pole piece 151 and yoke 152, respectively.

Although preferred embodiments have been described hereinbefore with reference to the drawings, it should be understood that various modification of the embodiments are possible without departing from the scope of the present invention. For example, make-side fixed-contact springs 21, 22 can also be embedded in base block 38, although in the structure of FIG. 4 only movable contact springs 31, 32 and break-side fixed-contact springs 33, 34 are embedded in base block 38.

We claim:

1. An electromagnetic relay comprising:

an electromagnet portion including a bobbin, a coil wound on said bobbin, a magnetic pole piece, and a magnetic yoke inserted in said bobbin, an armature of a straight bar shape arranged adjacent to said magnetic pole piece, and a card outside of said bobbin and coupled to a portion of said armature extending outside of said bobbin;

a spring holding portion including a base block, a first fixed contact spring and a movable contact spring, said first fixed contact spring and said movable contact spring being embedded in said base block, said movable contact spring being adapted to be driven by said card; and a second fixed contact spring located between and in contact with said bobbin, at an end of the bobbin nearest said card, and an upper face of said holding portion, and wherein said second fixed contact spring has at least a first hole therein, corresponding and engageable with a projection on said base block so that said second fixed contact spring is correctly located when joined with said base block, such that said electromagnet portion, said second fixed contact spring and said spring holding portion may be assembled by placing said second fixed contact spring between said electromagnet portion and said holding portion.

2. The electromagnetic relay of claim 1, wherein said second fixed contact spring is supported on the underside thereof along its entire length by said base block.

3. The electromagnetic relay of claim 2, wherein said second fixed contact spring has a second hole corresponding with a hole in said base block for receiving therein a projection extending from said bobbin to firmly hold said second fixed contact spring and said base block against said bobbin in a properly assembled position.

* * * * *